US009791189B2

(12) United States Patent
Matsui et al.

(10) Patent No.: US 9,791,189 B2
(45) Date of Patent: Oct. 17, 2017

(54) HEAT EXCHANGER AND REFRIGERATION CYCLE APPARATUS

(71) Applicant: Mitsubishi Electric Corporation, Tokyo (JP)

(72) Inventors: Shigeyoshi Matsui, Tokyo (JP); Takuya Matsuda, Tokyo (JP); Keisuke Hokazono, Tokyo (JP); Hiroki Okazawa, Tokyo (JP); Takashi Okazaki, Tokyo (JP); Akira Ishibashi, Tokyo (JP); Atsushi Mochizuki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/783,250

(22) PCT Filed: May 8, 2013

(86) PCT No.: PCT/JP2013/062934

§ 371 (c)(1),
(2) Date: Oct. 8, 2015

(87) PCT Pub. No.: WO2014/181400

PCT Pub. Date: Nov. 13, 2014

(65) Prior Publication Data

US 2016/0054038 A1 Feb. 25, 2016

(51) Int. Cl.
*F25B 39/00* (2006.01)
*F25B 13/00* (2006.01)
(Continued)

(52) U.S. Cl.
CPC ..... *F25B 39/00* (2013.01); *F25B 13/00* (2013.01); *F25B 39/04* (2013.01); *F28D 1/0476* (2013.01);
(Continued)

(58) Field of Classification Search
CPC ..... F25B 13/00; F25B 39/04; F25B 39/00; F25B 39/028; F25B 39/02; F25B 39/022;
(Continued)

(56) References Cited

U.S. PATENT DOCUMENTS

2001/0020367 A1* 9/2001 Funaba ..... F23M 9/10 62/238.3
2002/0020521 A1* 2/2002 Hoshino ..... F25B 39/024 165/174
(Continued)

FOREIGN PATENT DOCUMENTS

JP S59-56054 A 3/1984
JP 09-145076 A 6/1997
(Continued)

OTHER PUBLICATIONS

Translation of JP 2008-261517 (A) to Akira et al. dated Oct. 30, 2008.*
(Continued)

*Primary Examiner* — Mohammad M Ali
(74) *Attorney, Agent, or Firm* — Posz Law Group, PLC

(57) ABSTRACT

A heat exchanger is configured such that flat tubes in at least two levels bent or connected to each other at one end in an axial direction of the flat tubes and the flat tubes in at least two columns connected to each other are included in refrigerant passages through which refrigerant flows, and a flow direction of gas is counter to flow of refrigerant through the refrigerant passages in a column direction while the heat exchanger serves as a condenser.

12 Claims, 5 Drawing Sheets

(51) Int. Cl.

| | |
|---|---|
| ***F25B 39/04*** | (2006.01) |
| ***F28D 1/047*** | (2006.01) |
| ***F28F 1/02*** | (2006.01) |
| ***F28F 1/24*** | (2006.01) |
| *F25B 39/02* | (2006.01) |
| *F28D 21/00* | (2006.01) |

(52) U.S. Cl.
CPC ..... *F28F 1/022* (2013.01); *F28F 1/24* (2013.01); *F25B 39/02* (2013.01); *F25B 39/028* (2013.01); *F28D 2021/007* (2013.01)

(58) Field of Classification Search
CPC ..... F28D 1/0476; F28D 2021/007; F28D 1/0477; F28D 1/053; F28D 2021/0071; F28D 2021/0073; F28F 1/022; F28F 1/24; F28F 1/02; F28F 1/325
USPC ..... 62/498; 165/173
See application file for complete search history.

(56) References Cited

U.S. PATENT DOCUMENTS

2005/0061494 A1* 3/2005 Tsuji ..... B21D 39/06 165/173
2007/0125527 A1* 6/2007 Flik ..... F02B 29/0412 165/140
2007/0267187 A1* 11/2007 Wolk ..... F28F 1/128 165/181
2008/0250805 A1* 10/2008 Daddis ..... A47F 3/0408 62/246
2009/0113711 A1* 5/2009 Tsuji ..... B21D 39/06 29/890.03
2012/0031139 A1* 2/2012 Shirota ..... F24F 1/0029 62/426

FOREIGN PATENT DOCUMENTS

| | | | |
|---|---|---|---|
| JP | 2000-241045 | A | 9/2000 |
| JP | 2001-272119 | A | 10/2001 |
| JP | 2004-37010 | A | 2/2004 |
| JP | 2005-351600 | A | 12/2005 |
| JP | 2006-125652 | A | 5/2006 |
| JP | 2007-192441 | A | 8/2007 |
| JP | 2008-261517 | A | 10/2008 |
| JP | 2011-127831 | A | 6/2011 |
| JP | 2011-153789 | A | 8/2011 |
| JP | 2012-032089 | A | 2/2012 |
| JP | 2012-218463 | A | 11/2012 |
| JP | 5071597 | B2 | 11/2012 |

OTHER PUBLICATIONS

International Search Report of the International Searching Authority mailed Aug. 13, 2013 for the corresponding international application No. PCT/JP2013/062934 (and English translation).
Office Action mailed Jul. 26, 2016 issued in corresponding JP patent application No. 2015-515670 (and English translation).
Office Action dated Sep. 18, 2016 issued in corresponding CN patent application No. 201380076370.7 (and English translation).
Office Action mailed Apr. 19, 2017 issued in corresponding CN Patent Application No. 201380076370.7 (and English translation).
Extended European Search Report dated Jan. 5, 2017 issued in corresponding European Patent Application No. 13884240.6.

* cited by examiner

HEAT EXCHANGER AND REFRIGERATION CYCLE APPARATUS

CROSS REFERENCE TO RELATED APPLICATION

This application is a U.S. national stage application of International Application No. PCT/JP2013/062934 filed on May 8, 2013, the disclosure of which is incorporated herein by reference.

TECHNICAL FIELD

The present invention relates to a heat exchanger and a refrigeration cycle apparatus.

BACKGROUND ART

Heat exchangers known in the art include a heat exchanger that includes a first header common pipe and a second header common pipe which are arranged upright, a plurality of flat tubes which are arranged in a column such that side surfaces of adjacent two of the tubes face each other, which are connected at one end to the first header common pipe and are connected at the other end to the second header common pipe, and each of which has therein a refrigerant passage, and a plurality of fins separating each of spaces defined by the flat tubes into a plurality of air passages through which air flows (refer to Patent Literature 1, for example).

CITATION LIST

Patent Literature

Patent Literature 1: Japanese Patent No. 5071597 (claim 1)

SUMMARY OF INVENTION

Technical Problem

A heat exchanger including flat tubes, serving as heat transfer tubes, has lower draft resistance of air than a heat exchanger including cylindrical tubes. Reducing an arrangement pitch of the heat transfer tubes enables high-density arrangement of the heat transfer tubes. The high-density arrangement of the heat transfer tubes included in a heat exchanger leads to an improvement in fin efficiency as well as an increase in area of heat transfer inside the heat transfer tubes, thus improving heat transfer performance of the heat exchanger.

The use of the flat heat transfer tubes, however, results in a reduction in cross-sectional area of a passage as well as an increase in the number of flat tubes arranged, leading to an increase in total length of passages of the flat tubes. This causes an increase in refrigerant pressure loss in the tubes. It is therefore necessary to increase the number of refrigerant streams to be distributed and increase the number of refrigerant passages (or the number of paths).

In the related art described in Patent Literature 1, a header type distributer is used to distribute refrigerant to the passages.

Header type distributers used in the art have distribution properties varying depending on the amount of refrigerant circulated. In a heat exchanger including flat tubes and accordingly having a very large number of refrigerant streams to be distributed, it is difficult to evenly distribute refrigerant to all of refrigerant passages. Unfortunately, the performance of such a heat exchanger is deteriorated.

In using the heat exchanger as an evaporator, refrigerant flowing into an inlet of the heat exchanger is in a two-phase gas-liquid state. As the number of refrigerant streams to be distributed is larger, it is accordingly more difficult to evenly distribute the refrigerant. Furthermore, a heat exchanger including heat transfer tubes arranged in multiple columns has a larger number of refrigerant streams to be distributed. It is accordingly more difficult to evenly distribute the refrigerant in such a heat exchanger.

An increase in refrigerant pressure loss in flat tubes causes a reduction in pressure of refrigerant passing through refrigerant passages of a heat exchanger, leading to a reduction in temperature of the refrigerant. If a change in temperature is caused while the refrigerant is passing through the heat exchanger as described above, it is preferred to eliminate or reduce a reduction in heat transfer performance of the heat exchanger.

If refrigerant passing through refrigerant passages of a heat exchanger is reduced in temperature to below 0 degrees C., moisture contained in gas exchanging heat with the refrigerant may freeze into frost on the surface of the heat exchanger. Disadvantageously, the frost on the heat exchanger may deteriorate the heat transfer performance of the heat exchanger.

The present invention has been made to solve the above-described disadvantages and provides a heat exchanger that facilitates even distribution of refrigerant to refrigerant passages and a refrigeration cycle apparatus. The present invention further provides a heat exchanger in which a deterioration in heat transfer performance of the heat exchanger is eliminated or reduced, and a refrigeration cycle apparatus.

Solution to Problem

The present invention provides a heat exchanger including a plurality of fins spaced apart from one another such that gas flows through spaces defined by the fins and a plurality of flat tubes through which refrigerant flows to exchange heat with the gas. The flat tubes extend through the fins. The flat tubes are arranged in multiple levels in a level direction orthogonal to a flow direction of the gas and are arranged in multiple columns in a column direction being along the flow direction of the gas. The flat tubes in at least two levels bent or connected to each other at one end in an axial direction of the flat tubes and the flat tubes in at least two columns connected to each other are included in refrigerant passages through which the refrigerant flows. The flow direction of the gas is counter to flow of the refrigerant through the refrigerant passages in the column direction while the heat exchanger serves as a condenser.

Advantageous Effects of Invention

The present invention can facilitate even distribution of refrigerant to refrigerant passages. Furthermore, the present invention can eliminate or reduce a degradation in heat transfer performance of the heat exchanger.

DESCRIPTION OF EMBODIMENTS

Embodiment 1

(Air-Conditioning Apparatus)

Figure 1:
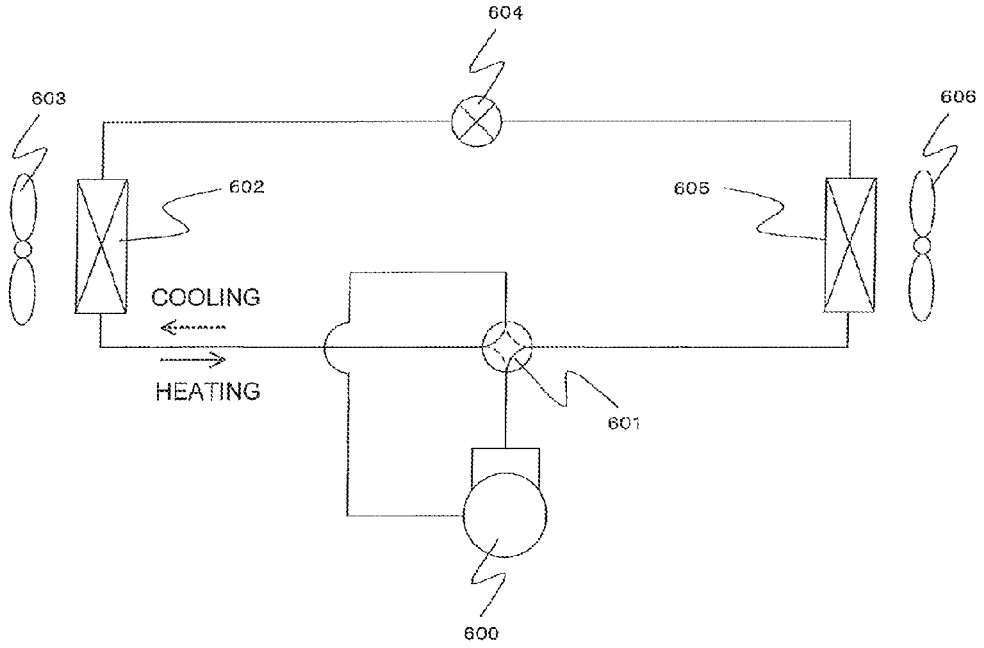
FIG. 1 is a diagram illustrating the configuration of an air-conditioning apparatus according to Embodiment 1 of the present invention.

FIG. 1 is a diagram illustrating the configuration of an air-conditioning apparatus according to Embodiment 1 of the present invention.

In Embodiment 1, the air-conditioning apparatus will be described as an example of a refrigeration cycle apparatus of the present invention.

Referring to FIG. 1, the air-conditioning apparatus includes a refrigerant circuit, through which refrigerant is circulated, including a compressor 600, a four-way valve 601, an outdoor side heat exchanger 602, an expansion valve 604, and an indoor side heat exchanger 605 connected sequentially by refrigerant pipes.

The air-conditioning apparatus further includes an outdoor fan 603 that sends air (outdoor air) to the outdoor side heat exchanger 602 and an indoor fan 606 that sends air (indoor air) to the indoor side heat exchanger 605.

The expansion valve 604 corresponds to an "expansion device" in the present invention.

The four-way valve 601 allows switching between refrigerant flow directions in the refrigerant circuit to switch between a heating operation and a cooling operation. If the air-conditioning apparatus is designed for cooling or heating only, the four-way valve 601 may be omitted.

The indoor side heat exchanger 605 is installed in an indoor unit. The indoor side heat exchanger 605 functions as a refrigerant evaporator in the cooling operation. The indoor side heat exchanger 605 functions as a refrigerant condenser in the heating operation.

The outdoor side heat exchanger 602 is installed in an outdoor unit. In the cooling operation, the outdoor side heat exchanger 602 functions as a condenser to heat, for example, air with heat from the refrigerant. In the heating operation, the outdoor side heat exchanger 602 functions as an evaporator to evaporate the refrigerant and cool, for example, air with heat of vaporization.

The compressor 600 compresses the refrigerant discharged from the evaporator to a high temperature state and supplies the refrigerant to the condenser.

The expansion valve 604 expands the refrigerant discharged from the condenser to a low temperature state and supplies the refrigerant to the evaporator.

The behavior of refrigerant in the heating operation and that in the cooling operation of the air-conditioning apparatus will now be described.

<Behavior of Refrigerant in Heating Operation>

In the heating operation, the four-way valve 601 is switched to a state indicated by solid lines in FIG. 1. High-temperature high-pressure refrigerant discharged from the compressor 600 passes through the four-way valve 601 and flows into the indoor side heat exchanger 605. Since the indoor side heat exchanger 605 functions as a condenser in the heating operation, the refrigerant that has flowed into the indoor side heat exchanger 605 exchanges heat with indoor air from the indoor fan 606 and transfers heat to the indoor air, so that the refrigerant decreases in temperature and turns to subcooled liquid refrigerant. The refrigerant then flows out of the indoor side heat exchanger 605.

The refrigerant that has left the indoor side heat exchanger 605 is depressurized to two-phase gas-liquid refrigerant by the expansion valve 604. The refrigerant then flows into the outdoor side heat exchanger 602. Since the outdoor side heat exchanger 602 functions as an evaporator in the heating operation, the refrigerant that has flowed into the outdoor side heat exchanger 602 exchanges heat with outdoor air from the outdoor fan 603, removes heat from the air, evaporates to gas refrigerant, and then flows out of the outdoor side heat exchanger 602. The refrigerant that has left the outdoor side heat exchanger 602 passes through the four-way valve 601 and is sucked into the compressor 600.

<Behavior of Refrigerant in Cooling Operation>

In the cooling operation, the four-way valve 601 is switched to a state indicated by dotted lines in FIG. 1. High-temperature high-pressure refrigerant discharged from the compressor 600 passes through the four-way valve 601 and flows into the outdoor side heat exchanger 602. Since the outdoor side heat exchanger 602 functions as a condenser in the cooling operation, the refrigerant that has flowed into the outdoor side heat exchanger 602 exchanges heat with outdoor air from the outdoor fan 603 and transfers heat to the air, so that the refrigerant decreases in temperature and turns to subcooled liquid refrigerant. The refrigerant then flows out of the outdoor side heat exchanger 602.

The refrigerant that has left the outdoor side heat exchanger 602 is depressurized to two-phase gas-liquid refrigerant by the expansion valve 604 and then flows into the indoor side heat exchanger 605. Since the indoor side heat exchanger 605 functions as an evaporator in the cooling operation, the refrigerant that has flowed into the indoor side heat exchanger 605 exchanges heat with indoor air from the indoor fan 606, removes heat from the air, evaporates to gas refrigerant, and then flows out of the indoor side heat exchanger 605. The refrigerant that has left the indoor side heat exchanger 605 passes through the four-way valve 601 and is sucked into the compressor 600.

(Heat Exchanger)

The configuration of a heat exchanger used as at least one of the outdoor side heat exchanger 602 and the indoor side heat exchanger 605 will now be described.

Figure 2:
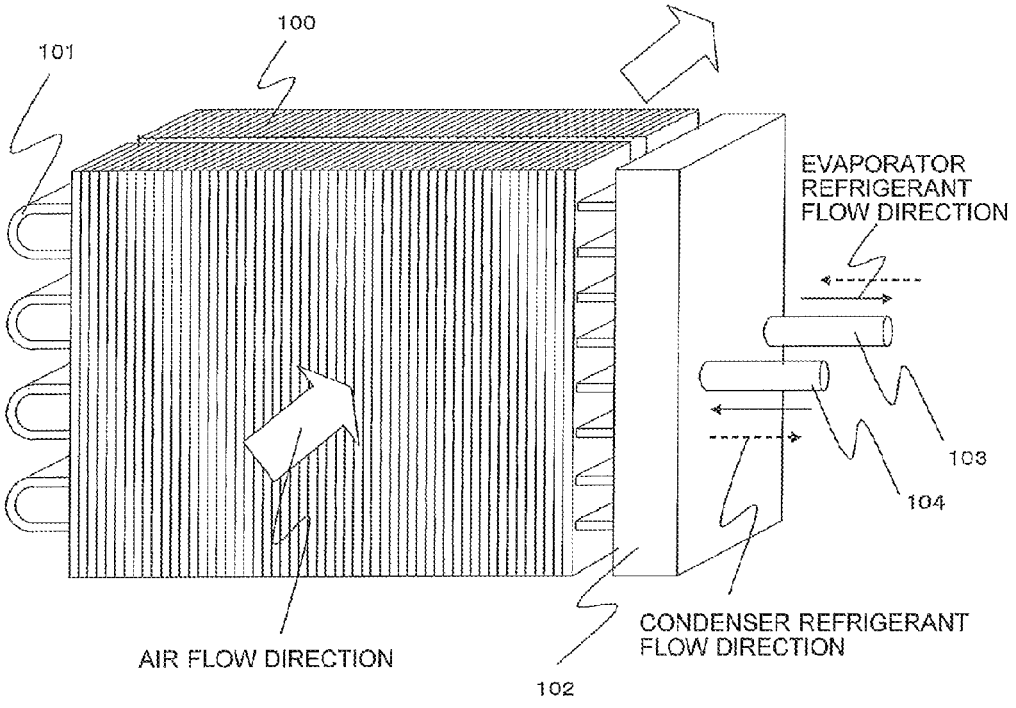
FIG. 2 is perspective view of a heat exchanger according to Embodiment 1 of the present invention.

FIG. 2 is a perspective view of the heat exchanger according to Embodiment 1 of the present invention.

Referring to FIG. 2, the heat exchanger includes a plurality of fins 100 and a plurality of flat tubes 101. This heat exchanger exchanges heat between gas, such as air, passing through spaces defined by the fins 100 and refrigerant flowing through the flat tubes 101.

The fins 100 are made of, for example, aluminum. The fins 100 each are plate-shaped. The fins 100 are arranged at predetermined intervals such that gas, such as air, flows through spaces defined by the fins. The fins 100 each have openings through which the flat tubes 101 extend. The flat tubes 101 extending through the openings are joined to the fins 100.

The flat tubes 101 are made of, for example, aluminum. The flat tubes 101 are heat transfer tubes having a low-profile or flat cross-sectional shape. The flat tubes 101 are arranged in multiple levels in a level direction orthogonal to an air flow direction and are also arranged in multiple columns in a column direction being along the air flow direction. The flat tubes 101 each having a flat cross-section that has a major axis and a minor axis are arranged in such a manner that the major axis extends in the air flow direction (column direction) and the flat tubes 101 are spaced apart from one another in the direction (level direction) along the minor axis of the flat cross-section. Furthermore, the flat tubes 101 in adjacent columns are displaced in relation to one another (in a staggered pattern) in the level direction.

FIG. 2 illustrates a case of the flat tubes 101 arranged in two columns. The number of levels of the flat tubes 101 will be described in detail later.

Figure 3:
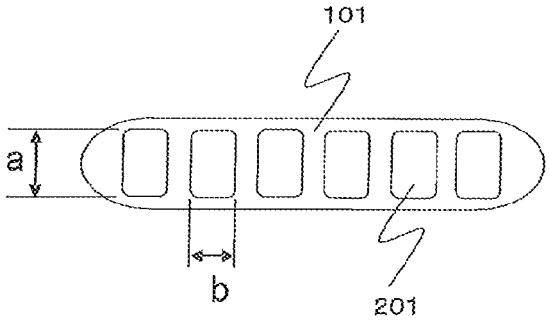
FIG. 3 is a cross-sectional view of a flat tube in Embodiment 1 of the present invention.

FIG. 3 is a cross-sectional view of the flat tube in Embodiment 1 of the present invention.

Referring to FIG. 3, each of the flat tubes 101 includes a plurality of subpassages 201 separated by division walls. For example, each of the subpassages 201 in the flat tube 101 has a substantially rectangular cross-section. The subpassage 201 has a dimension a in the direction along the minor axis of the flat tube 101 and a dimension b in the direction along the major axis thereof.

Again referring to FIG. 2, at one end of the heat exchanger, the flat tubes 101 are connected to a header 102. At the other end of the heat exchanger, the flat tubes 101 have bent portions, for example, U-shaped portions, at one end in an axial direction of the flat tubes 101. Specifically, two adjacent levels in the same column corresponds to one U-shaped bent flat tube 101.

Although a case where the flat tubes 101 are bent in a U-shape is described, the present invention is not limited to this case. For example, an end of each flat tube 101 in the axial direction may be connected to that of another flat tube 101 in the next level by a U-bend tube or the like.

The header 102 is connected to a refrigerant pipe 103 and a refrigerant pipe 104. While the heat exchanger serves as a condenser, the header 102 divides the refrigerant flowing from the refrigerant pipe 103 into a plurality of refrigerant steams and allows the refrigerant streams to flow into the flat tubes 101. The header 102 combines the refrigerant streams passed through the flat tubes 101 and allows the refrigerant to flow through the refrigerant pipe 104.

While the heat exchanger serves as an evaporator, the refrigerant flows in a direction opposite to the above-described flow direction.

Figure 4:
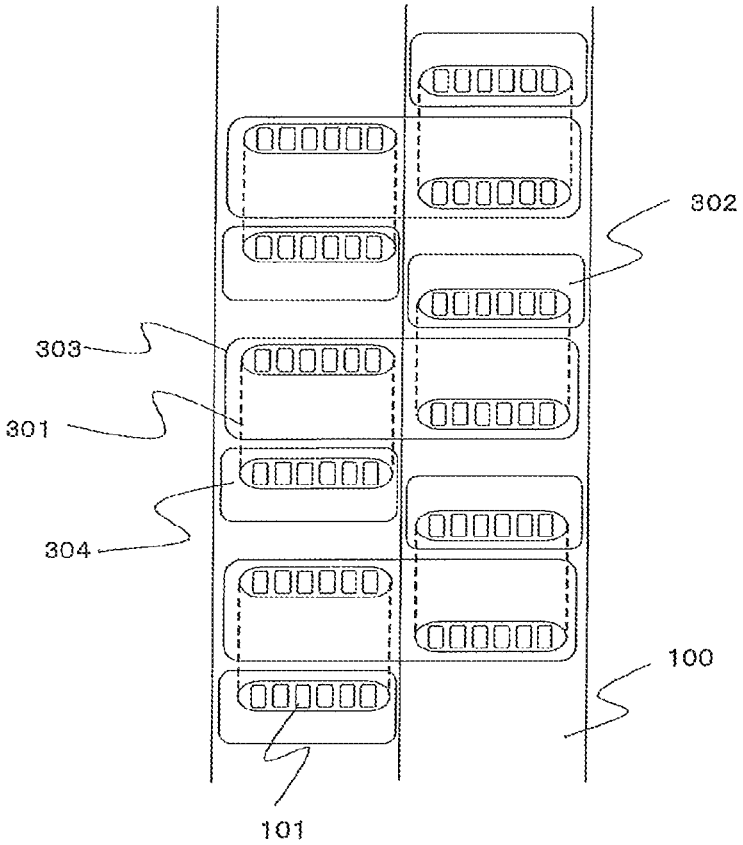
FIG. 4 is a diagram explaining refrigerant passages of the heat exchanger according to Embodiment 1 of the present invention.

FIG. 4 is a diagram explaining refrigerant passages in the heat exchanger according to Embodiment 1 of the present invention. FIG. 4 is a cross-sectional view of the heat exchanger when viewed from the side adjacent to the header 102.

As illustrated in FIG. 4, the header 102 includes flow inlets 302, column connecting passages 303, and flow outlets 304.

Each of the flow inlets 302 is connected to one end of the U-shaped bent flat tube 101. Each of the column connecting passages 303 is connected to the other end of the U-shaped bent flat tube 101. The column connecting passage 303 connects the flat tubes 101 in adjacent columns. The passage 303 is connected to the other end of the U-shaped bent flat tube 101.

As described above, the flat tubes 101 in at least two levels and the flat tubes 101 in at least two columns are included in one refrigerant passage (path) through which the refrigerant flows.

Although the case where the flat tubes 101 arranged in two levels by two columns are included in one refrigerant passage (path) through which the refrigerant flows has been described above, the present invention is not limited to this case. For example, ends of the flat tubes 101 arranged in the same column may be connected to one another such that the flat tubes 101 in two or more levels are included in one refrigerant passage.

In other words, the number of levels of flat tubes 101 per refrigerant passage (the number of levels/the number of paths) is two or more.

Although the case where the header 102 includes the column connecting passages 303 has been described above, the present invention is not limited to this case. For example, the end of each of the flat tubes 101 adjacent to the header 102 may be connected to the end of the flat tube 101 in the other column by a U-bend tube or the like.

Figure 5:
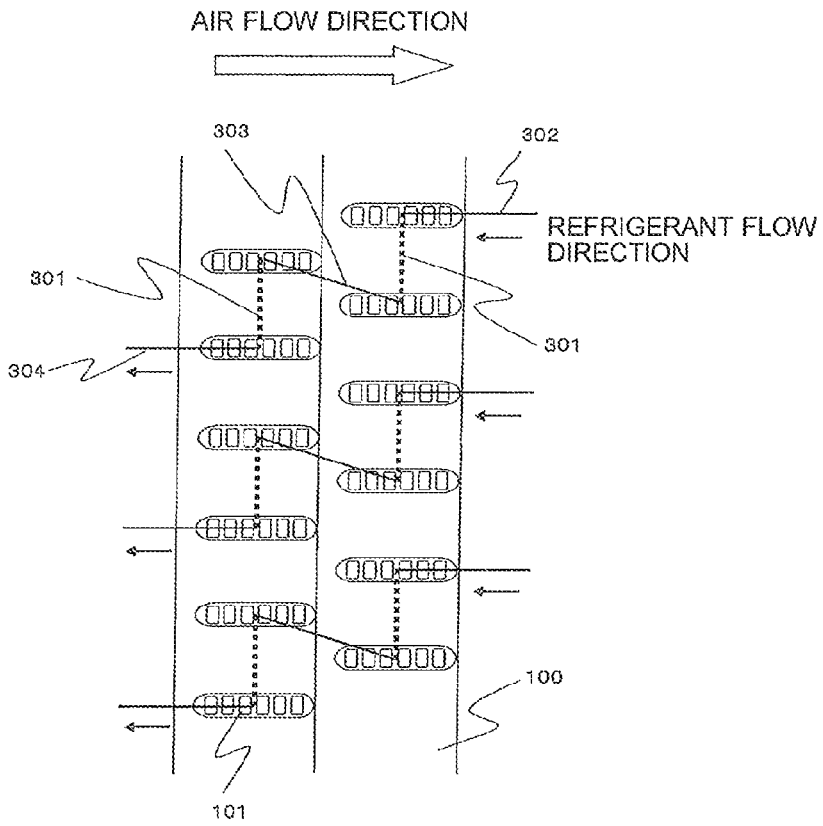
FIG. 5 is a diagram schematically illustrating a refrigerant flow direction and an air flow direction in a case where the heat exchanger according to Embodiment 1 of the present invention serves as a condenser.

FIG. 5 is a diagram schematically illustrating the refrigerant flow direction and the air flow direction in the case where the heat exchanger according to Embodiment 1 of the present invention serves as a condenser.

Referring to FIG. 5, while the heat exchanger serves as a condenser, the refrigerant flowing from the refrigerant pipe 103 into the header 102 is divided into a plurality of refrigerant streams by a dividing passage in the header 102. The refrigerant steams are allowed to flow into the flat tubes 101 through the flow inlets 302.

Each refrigerant stream that has flowed into the flat tube 101 passes through a return passage 301 of the U-shaped bent flat tube 101 and then flows into the column connecting passage 303 of the header 102.

The refrigerant stream that has flowed into the column connecting passage 303 flows into the flat tube 101 in the next column, passes through the return passage 301 in the next column, and then flows through the flow outlet 304 into the header 102.

The refrigerant streams that have flowed through the respective flow outlets 304 into the header 102 are combined into a single stream by a combining passage in the header 102. The refrigerant then flows through the refrigerant pipe 104.

While the heat exchanger serves as an evaporator, the refrigerant flows in the direction opposite to the above-described direction.

In the case where the heat exchanger serves as a condenser, the refrigerant flows through the flat tubes 101 in the column on a downstream side in the air flow direction and then flows through the flat tubes 101 in the column on an upstream side in the air flow direction. In other words, the flow of the refrigerant through the refrigerant passages in the column direction is counter to the flow of air in the air flow direction.

As described above, the flat tubes 101 in at least two levels bent or connected to each other at one end in the axial direction of the flat tubes and the flat tubes 101 in at least two columns connected to each other are included in the refrigerant passages through which the refrigerant flows.

This enables the number of paths to be smaller than that in a configuration in which a refrigerant passage (path) is provided for each of the flat tubes 101, thus facilitating even distribution of the refrigerant to the respective refrigerant passages. In addition, the reduction in the number of paths leads to a reduction in the number of refrigerant streams to be distributed in the header 102. This facilitates even distribution of the refrigerant with a header type distributer.

Additionally, the U-shaped bent portions of the flat tubes 101 used as the refrigerant return passages 301 allow an increase in the effective area of heat transfer of the heat exchanger, thus improving heat transfer performance of the heat exchanger.

In addition, since the flat tubes 101 are bent at one end in the axial direction to provide the return passages 301, it is unnecessary to provide, for example, the headers 102 on both sides of the flat tubes 101 in the axial direction. This can increase the effective area of heat transfer of the heat exchanger, thus improving the heat transfer performance.

Additionally, since it is unnecessary to provide, for example, the headers 102 on both the sides of the flat tubes 101 in the axial direction, an installation space for the heat exchanger can be reduced.

Furthermore, since the flat tubes 101 are bent at one end in the axial direction to provide the return passages 301, the return passages 301 have no junction of tubes, thus reducing the risk of refrigerant leakage.

A change in temperature of air and that of the refrigerant in the case where the heat exchanger serves as a condenser will now be described.

Figure 6:
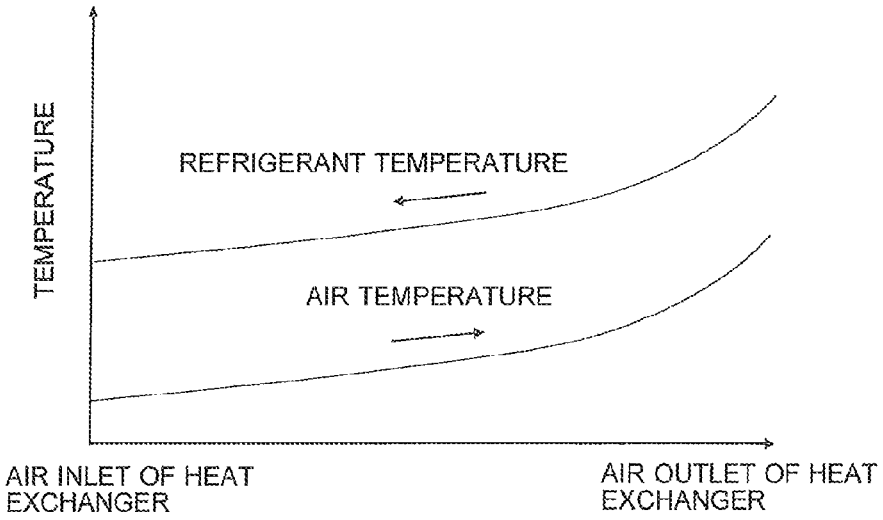
FIG. 6 is a diagram illustrating a change in temperature of air and that of refrigerant in the case where the heat exchanger according to Embodiment 1 of the present invention serves as a condenser.

FIG. 6 is a diagram illustrating a change in temperature of air and that of the refrigerant in the case where the heat exchanger according to Embodiment 1 of the present invention serves as a condenser.

Referring to FIG. 6, while the heat exchanger serves as a condenser, air passing through the spaces defined by the fins 100 is heated by the refrigerant passing through the flat tubes 101, so that the temperature of the air rises.

For the refrigerant passing through the flat tubes 101, the pressure of the refrigerant decreases due to pressure loss (friction loss) in the tubes. Along with the decrease in pressure, the temperature of the refrigerant falls. While the heat exchanger serves as a condenser, the refrigerant flows in the column direction from the downstream side (an air outlet of the heat exchanger) in the air flow direction to the upstream side (an air inlet of the heat exchanger) in the air flow direction.

Consequently, the temperature of the refrigerant is high at the air outlet of the heat exchanger at which the temperature of the air has risen, whereas the temperature of the refrigerant is low at the air inlet of the heat exchanger at which the temperature of the air has not yet risen. Specifically, while the heat exchanger serves as a condenser, allowing the flow of air to be counter to the flow of the refrigerant in the column direction enables the refrigerant and the air to have a difference in temperature therebetween at all times.

This can improve the heat transfer performance of the heat exchanger used as a condenser.

A change in temperature of air and that of the refrigerant in the case where the heat exchanger serves as an evaporator will now be described.

Figure 7:
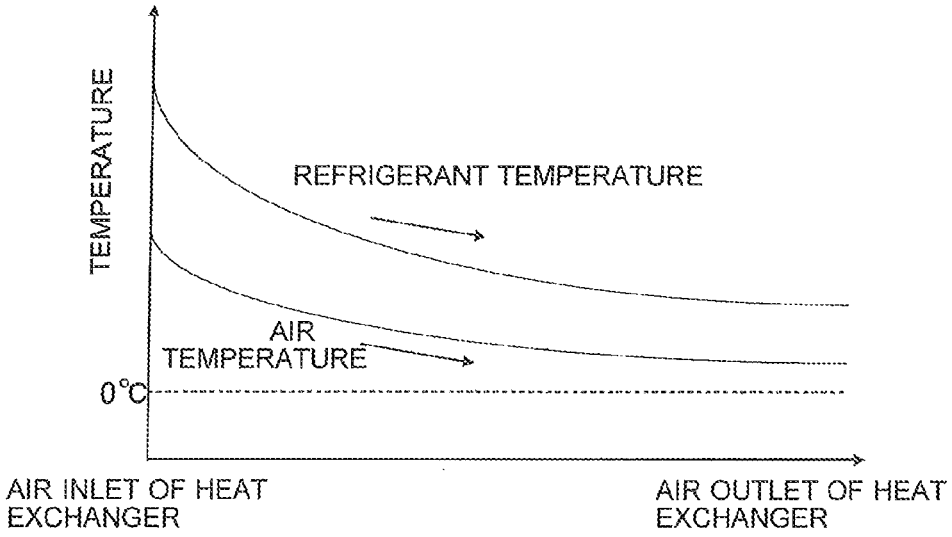
FIG. 7 is a diagram illustrating a change in temperature of air and that of the refrigerant in a case where the heat exchanger according to Embodiment 1 of the present invention serves as an evaporator.

FIG. 7 is a diagram illustrating a change in temperature of air and that of the refrigerant in the case where the heat exchanger according to Embodiment 1 of the present invention serves as an evaporator.

Referring to FIG. 7, while the heat exchanger serves as an evaporator, air passing through the spaces defined by the fins 100 is cooled by the refrigerant passing through the flat tubes 101, so that the temperature of the air falls.

For the refrigerant passing through the flat tubes 101, the pressure of the refrigerant decreases due to pressure loss (friction loss) in the tubes. Along with the decrease in pressure, the temperature of the refrigerant falls. While the heat exchanger serves as an evaporator, the refrigerant flows in the column direction from the upstream side (the air inlet of the heat exchanger) in the air flow direction to the downstream side (the air outlet of the heat exchanger) in the air flow direction. In other words, the flow of the refrigerant through the refrigerant passages in the column direction is parallel to the flow of air in the air flow direction.

Consequently, the temperature of the refrigerant is high at the air inlet of the heat exchanger at which the temperature of the air has not yet fallen, whereas the temperature of the refrigerant is low at the air outlet of the heat exchanger at which the temperature of the air has fallen. Specifically, while the heat exchanger serves as an evaporator, allowing the flow of air to be parallel to the flow of the refrigerant in the column direction enables the refrigerant and the air to have a difference in temperature therebetween at all times.

This can improve the heat transfer performance of the heat exchanger used as an evaporator.

If the temperature (evaporating temperature) of the refrigerant is below 0 degrees C. while the heat exchanger serves as an evaporator, moisture contained in the air exchanging heat with the refrigerant may freeze into frost on the fins 100 and the flat tubes 101. To prevent the deposition of frost on the heat exchanger, the evaporating temperature has to be maintained at or above 0 degrees C.

As described above, the pressure of the refrigerant passing through the flat tubes 101 decreases due to pressure loss (friction loss) in the tubes. Along with the decrease in pressure, the temperature of the refrigerant falls.

In the heat exchanger according to Embodiment 1, the flat tubes 101 in at least two levels are included in the refrigerant passages through which the refrigerant flows. Too large a number of levels of flat tubes 101 included in one refrigerant passage causes an increase in length of the refrigerant passage, leading to an increase in pressure loss.

For the above-described reasons, the number of levels of flat tubes 101 per refrigerant passage (the number of levels/the number of paths) is set so that the evaporating temperature reduced by refrigerant pressure loss in one refrigerant passage exceeds 0 degrees C.

In other words, the number of levels of flat tubes 101 per refrigerant passage (the number of levels/the number of paths) is the number of levels that allows refrigerant pressure loss in one refrigerant passage to be less than or equal to a predetermined value while the heat exchanger serves as an evaporator. A specific description will now be given.

As known, friction loss (pressure loss) $\Delta P_f$ [Pa] in a tube through which single-phase gas refrigerant flows is typically expressed by Expression (1).

[Math. 1]

$$\Delta P_f = f \cdot \frac{l}{De} \cdot \rho_v \cdot \frac{u^2}{2} \tag{1}$$

f: Tube friction loss coefficient [−]

I: Passage length [m]

De: Tube hydraulic diameter [m]

$\rho_v$: Density [kg/m$^3$] of single-phase gas refrigerant u: Flow velocity [m/s] of fluid flowing in tube The tube friction loss coefficient f is typically approximately 0.01.

The flow velocity u in tube is calculated by using Expression (2).

[Math. 2]

$$u - \frac{G}{\pi De^2} \tag{2}$$

G: Refrigerant circulation amount [kg/s]

For the refrigerant circulation amount G, the amount (maximum amount) of circulation of the refrigerant flowing into the heat exchanger in a rated operation of the air-conditioning apparatus is used. In other words, the refrigerant circulation amount is calculated under conditions where pressure loss is maximized.

For example, G=60×hp, where hp is horsepower [kg/h] of the air-conditioning apparatus.

To replace a phenomenon in a complex passage with a dynamically similar flow in a cylindrical tube, the hydraulic diameter De is defined so that the ratio of pressure acting on the cross-section of the passage to fluid friction at a wetted perimeter is equal to that in the cylindrical tube. The hydraulic diameter De is expressed by Expression (3).

[Math. 3]

$$De = \frac{4 \times A}{C} \tag{3}$$

A: Passage cross-sectional area [m$^2$]

C: Wetted perimeter length [m]

In the case where the flat tubes 101 each include the subpassages 201 as illustrated in FIG. 3, the hydraulic diameter De can be calculated on the basis of the major axis a and the minor axis b of one subpassage 201 by using Expression (4).

[Math. 4]

$$De = \frac{4ab}{2(a+b)} \tag{4}$$

The passage length I per refrigerant passage (per path) of the heat exchanger can be calculated by using Expression (5).

[Math. 5]

$$l = \frac{L \times D_n \times N_r}{N_p} \tag{5}$$

L: Stack length [m]

$D_n$: The number of levels of flat tubes 101

$N_r$: The number of columns of flat tubes 101

$N_p$: The number of refrigerant passages (the number of paths)

The stack length L is a distance between the end of the flat tube 101 adjacent to the header 102 and the other end thereof at which the flat tube 101 is bent in a U-shape.

While the heat exchanger serves as an evaporator, two-phase gas-liquid refrigerant flows through the flat tubes 101. Friction loss ΔP [Pa] in a tube through which two-phase gas-liquid refrigerant flows is calculated on the basis of the friction loss $\Delta P_f$ [Pa] in the tube through which single-phase gas refrigerant flows and a friction loss increase coefficient $\phi_v$ [−] in two-phase gas-liquid flow by using Expression (6).

[Math. 6]

$$\Delta P = \Delta P_f \phi_v^2 \tag{6}$$

The friction loss increase coefficient $\phi_v$ in two-phase gas-liquid flow is calculated by using Expressions (7) and (8).

[Math. 7]

$$\phi_v^2 = 1 + 21X + X^2 \tag{7}$$

[Math. 8]

$$X = \left(\frac{1-x}{x}\right)^{0.9} \cdot \left(\frac{\rho_V}{\rho_L}\right)^{0.5} \cdot \left(\frac{\eta_L}{\eta_V}\right)^{0.1} \tag{8}$$

x: Refrigerant quality [−]

$\rho_v$: Gas density [kg/m$^3$]

$\mu_L$: Liquid density [kg/m$^3$]

$\eta_v$: Gas viscosity [Pa·s]

$\eta_L$: Liquid viscosity [Pa·s]

For the refrigerant quality x, for example, a mean value of the quality of refrigerant flowing into the evaporator and the quality of refrigerant flowing out of the evaporator is used. For example, the refrigerant quality x is approximately 0.6.

The gas density $\rho_v$ is determined on the basis of physical properties of the refrigerant under conditions where the temperature of the refrigerant flowing into the heat exchanger is minimized. Specifically, the gas density $\rho_v$ is calculated under conditions where the temperature of the refrigerant flowing into the heat exchanger estimated in accordance with, for example, the specification of the air-conditioning apparatus, is minimized.

Each of the liquid density $\rho_L$, the gas viscosity $\eta_v$, and the liquid viscosity $\eta_L$ approximates to a constant value regardless of an operation state of the air-conditioning apparatus and is determined on the basis of the physical properties of the refrigerant.

To prevent the deposition of frost on the heat exchanger, the evaporating temperature has to be maintained at or above 0 degrees C. In other words, a saturated vapor temperature has to be at or above 0 degrees C.

A reduction in pressure caused by the friction loss (pressure loss) $\Delta P_f$ in the refrigerant passages has to be less than or equal to the difference between a pressure under conditions where the temperature of the refrigerant flowing into the heat exchanger is minimized and a saturated pressure.

Assuming that the difference is a predetermined upper limit $P_{max}$ [Pa], the friction loss (pressure loss) $\Delta P_f$ has to satisfy Expression (9).

[Math. 9]

$$\Delta P \leq P_{max} \tag{9}$$

For example, it is assumed that the temperature of the refrigerant flowing into the heat exchanger is 5 degrees C. If the saturated evaporating temperature is reduced to 0 degrees C. by pressure loss in the refrigerant passages, the difference between the pressure of the refrigerant flowing into the heat exchanger and the saturated pressure is approximately 100 [kPa].

The number of levels of flat tubes 101 per refrigerant passage (the number of levels/the number of paths) has to satisfy Expression (10) on the basis of Expressions (1) to (9).

[Math. 10] (10)

$$D_n / N_p \leq \frac{P_{max} \times \pi^2 \rho_V}{8G^2 x^2 \phi_V^2 f} \cdot \frac{De^5 \times (N_p \times n)^2}{L \times N_r}$$

The first term on the right side of Expression (10) is regarded as a constant K that is determined in accordance with, for example, the specification of the air-conditioning apparatus and the physical properties of the refrigerant. Since the flat tubes 101 in at least two levels are included in one refrigerant passage through which the refrigerant flows, the number of levels of flat tubes 101 per refrigerant passage (the number of levels/the number of paths) is two or more.

In summary, the number of levels of flat tubes 101 per refrigerant passage (the number of levels/the number of paths) satisfies the relationship given by Expression (11).

[Math. 11] (11)

$$2 \leq D_n / N_p \leq K \cdot \frac{De^5 \times (N_p \times n)^2}{L \times N_r}$$

$$K = \frac{P_{max} \times \pi^2 \rho_V}{8G^2 x^2 \phi_V^2 f}$$

$D_n$: The number of levels of flat tubes 101

$N_p$: The number of refrigerant passages (the number of paths)

De: Hydraulic diameter [m] of flat tube n: The number of subpassages 201 in flat tube 101

L: Stack length [m]

$N_r$: The number of columns of flat tubes 101

$P_{max}$: Predetermined upper limit [Pa]

$\rho_v$: Saturated gas density [kg/m$^3$] at refrigerant evaporating temperature G: Circulation amount [kg/h] of refrigerant flowing into heat exchanger x: Refrigerant quality [−]

$\phi_v$: Friction loss increase coefficient [−] in two-phase flow f: Tube friction loss coefficient [−]

The constant K can be approximated as expressed by, for example, Expression (12), provided that the predetermined upper limit $P_{max}$ is 100 [kPa] and the refrigerant circulation amount G=60×hp [kg/h].

[Math. 12]

$$K = \frac{100 \times 10^3 \times \pi^2 \rho_V}{8G^2 x^2 \phi_V^2 f} \fallingdotseq \frac{5.1 \times 10^{11}}{\text{hp}^2} \quad (12)$$

The right side (upper limit) of Expression (11) contains the fifth power of the hydraulic diameter De. An upper limit of the number of levels of flat tubes 101 per refrigerant passage (the number of levels/the number of paths) is most affected by the hydraulic diameter De of the flat tube 101. Specifically, the number of levels of flat tubes 101 per refrigerant passage (the number of levels/the number of paths) is a value based at least on the hydraulic diameter De of the flat tube 101 and is also the number of levels that allows refrigerant pressure loss in one refrigerant passage to be less than or equal to the predetermined value while the heat exchanger serves as an evaporator.

As described above, the number of levels of flat tubes 101 per refrigerant passage is set to a value that allows the evaporating temperature reduced by refrigerant pressure loss in one refrigerant passage to exceed 0 degrees C. under conditions where the circulation amount G of the refrigerant flowing into the heat exchanger used as an evaporator is a maximum value and the temperature of the refrigerant flowing into the heat exchanger is a minimum value.

This can prevents the deposition of frost on the heat exchanger used as an evaporator caused by a reduction in evaporating temperature, thus preventing a deterioration in heat transfer performance of the heat exchanger.

(Shape of Heat Exchanger)

The shape of the heat exchanger will now be described.

Figure 8:
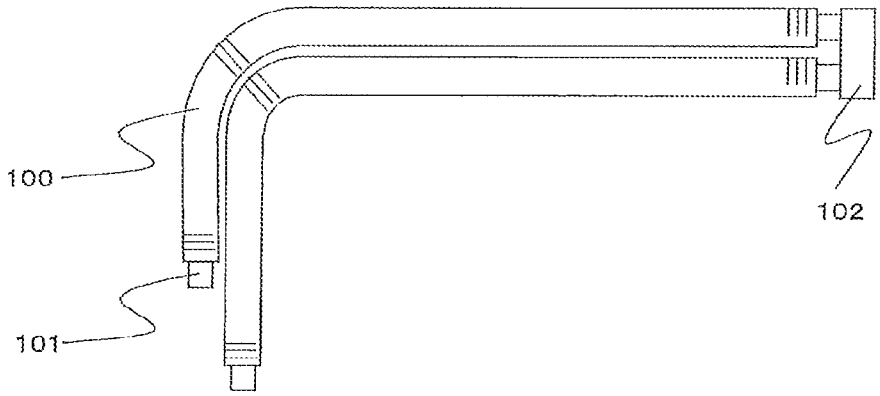
FIG. 8 is a top view of the heat exchanger according to Embodiment 1 of the present invention bent in an L-shape in a column direction.

FIG. 8 is a top view of the heat exchanger according to Embodiment 1 of the present invention bent in an L-shape in the column direction.

Referring to FIG. 8, the fins 100 are provided for each level of the flat tubes 101. The flat tubes 101 may be bent at least one position in the axial direction of the flat tubes 101. Although FIG. 8 illustrates a case where the flat tubes 101 are bent in an L-shape in the column direction, the present invention is not limited to this case. The flat tubes 101 may be bent in, for example, a U-shape or a rectangular shape.

In the heat exchanger according to Embodiment 1, the flat tubes 101 are bent in a U-shape at one end and are connected together at the other end by the header 102.

Consequently, for example, as illustrated in FIG. 8, bending can be performed such that the columns have different curvatures.

(Modification)

Figure 9:
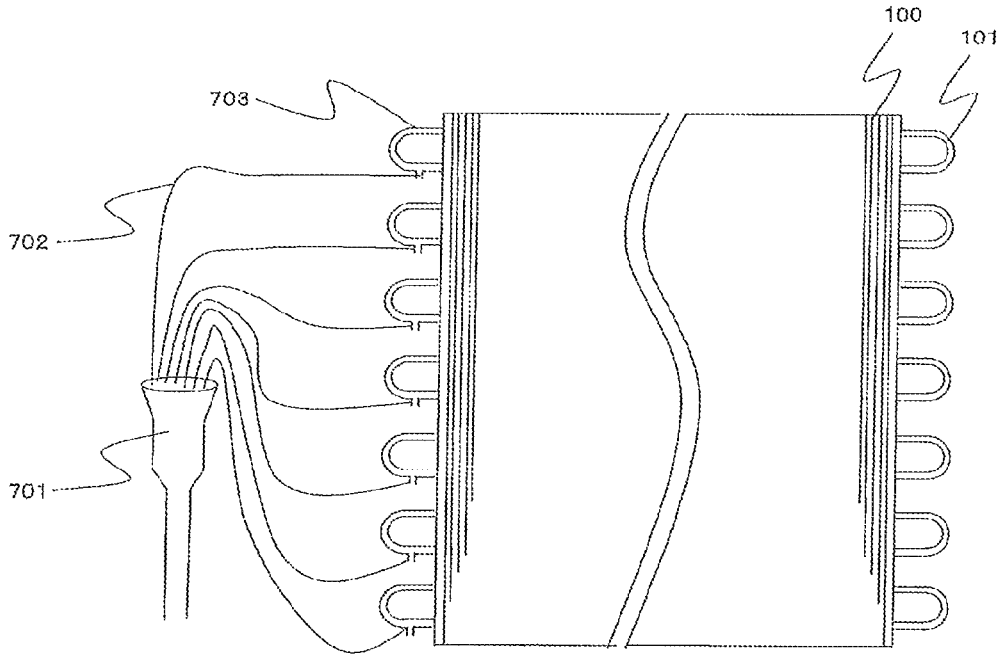
FIG. 9 is a diagram illustrating another configuration of the heat exchanger according to Embodiment 1 of the present invention.

FIG. 9 is a diagram illustrating another configuration of the heat exchanger according to Embodiment 1 of the present invention.

As illustrated in FIG. 9, the heat exchanger may include, instead of the above-described header 102, a distributer 701 that divides refrigerant into a plurality of refrigerant streams, a plurality of bifurcation tubes 703 arranged at ends of the flat tubes 101, and capillary tubes 702 connecting the distributer 701 to the bifurcation tubes 703.

In this configuration, at one end (right end in FIG. 9) of the heat exchanger, the flat tubes 101 have bent portions, for example, U-shaped portions, at one end in the axial direction of the flat tubes 101. Additionally, at the other end (left end in FIG. 9) of the heat exchanger, each of the bifurcation tubes 703 connects the flat tubes 101 in adjacent two of the levels.

Such a configuration can offer the same advantages as those in the foregoing configuration.

In Embodiment 1, the air-conditioning apparatus has been described as an example of the refrigeration cycle apparatus according to the present invention. The present invention is not limited to this example. The present invention is applicable to any other refrigeration cycle apparatuses, such as a refrigeration system and a heat pump apparatus, each including a refrigerant circuit that includes a heat exchanger functioning as an evaporator or a condenser.

REFERENCE SIGNS LIST

100 fin, 101 flat tube, 102 header, 103 refrigerant pipe, 104 refrigerant pipe, 201 subpassage, 301 return passage,

302 flow inlet, 303 column connecting passage, 304 flow outlet, 600 compressor, 601 four-way valve, 602 outdoor side heat exchanger, 603 outdoor fan, 604 expansion valve, 605 indoor side heat exchanger, 606 indoor fan, 701 distributer, 702 capillary tube, 703 bifurcation tube

The invention claimed is:

1. A heat exchanger comprising:

a plurality of fins spaced apart from one another such that gas flows through spaces defined by the fins; and a plurality of flat tubes through which refrigerant flows to exchange heat with the gas, the flat tubes extending through the fins, the flat tubes being arranged in multiple levels in a level direction orthogonal to a flow direction of the gas and being arranged in multiple columns in a column direction being along the flow direction of the gas, the flat tubes forming refrigerant passages through which the refrigerant flows, by having a bend connecting at least two levels of the flat tubes at one end in an axial direction of the flat tubes, or a connection connecting at least two levels of the flat tubes to each other at the one end in the axial direction of the flat tubes, and being connected to each other in at least two columns, wherein a number of the refrigerant passages, a number of levels of the flat tubes, a hydraulic diameter per subpassage in each of the flat tubes, a number of subpassages in each of the flat tubes, a stack length of each of the flat tubes, and a number of columns of the flat tubes satisfy a relationship given by Expression (1):

$$2 \le D_n / N_p \le K \cdot \frac{De^5 \times (N_p \times n)^2}{L \times N_r} \quad (1)$$

where $D_n$ is the number of levels of the flat tubes, $N_p$ is the number of the refrigerant passages, K is a constant determined by an upper limit pressure loss of the refrigerant in each of the refrigerant passages while the heat exchanger serves as an evaporator, $D_e$ is the hydraulic diameter per subpassage in each of the flat tubes, n is the number of subpassages in each of the flat tubes, L is a stack length of each of the flat tubes, and $N_r$ is the number of columns of the flat tubes.

2. The heat exchanger of claim 1, wherein the fins are provided for each of the levels of the flat tubes, and wherein the flat tubes are bent at at least one position in the axial direction.

3. A refrigeration cycle apparatus comprising:

a refrigerant circuit through which refrigerant is circulated, the refrigerant circuit including a compressor, a condenser, an expansion device, and an evaporator connected sequentially by pipes, at least one of the condenser and the evaporator being the heat exchanger of claim 1.

4. A refrigeration cycle apparatus comprising:

a refrigerant circuit through which refrigerant is circulated, the refrigerant circuit including a compressor, a condenser, an expansion device, and an evaporator connected sequentially by pipes, at least one of the condenser and the evaporator being the heat exchanger of claim 1, the number of levels of the flat tubes for each of the refrigerant passages of the evaporator being set to a value that allows an evaporating temperature reduced by pressure loss of the refrigerant in the one of the refrigerant passages to exceed 0 degrees C. under a condition where a circulation amount of the refrigerant flowing into the evaporator is a maximum value and a temperature of the refrigerant flowing into the evaporator is a minimum value.

5. The heat exchanger of claim 1, wherein the flow direction of the gas is counter to flow of the refrigerant through the refrigerant passages in the column direction while the heat exchanger serves as a condenser.

6. The heat exchanger of claim 1, wherein the K being constant satisfies a relationship given by Expression (2):

$$K = \frac{P_{max} \times \pi^2 \rho_V}{8G^2 x^2 \phi_V^2 f_r} \quad (2)$$

where $P_{max}$ is a difference between a pressure under conditions where a temperature of the refrigerant flowing into the heat exchanger is minimized and a saturated pressure, $\rho_V$ is saturated gas density at a minimized refrigerant evaporating temperature, G is a maximized circulation amount of the refrigerant flowing into the heat exchanger, x is a mean value of a quality of the refrigerant flowing into the evaporator and a quality of the refrigerant flowing out of the evaporator, $\phi_V$ is a friction loss increase coefficient in a two-phase flow which is determined on the basis of physical properties of the refrigerant, and f is a tube friction loss coefficient.

7. A heat exchanger comprising:

a plurality of fins spaced apart from one another such that gas flows through spaces defined by the fins; and a plurality of flat tubes through which refrigerant flows to exchange heat with the gas, the flat tubes extending through the fins, the flat tubes being arranged in multiple levels in a level direction orthogonal to a flow direction of the gas and being arranged in multiple columns in a column direction being along the flow direction of the gas, the flat tubes forming refrigerant passages, and the refrigerant passages being arranged in at least two columns and being connected to each other, each refrigerant passage containing a bend connecting at least two levels of the flat tubes at one end in an axial direction of the flat tubes, or a connection connecting at least two levels of the flat tubes to each other at the one end in the axial direction of the flat tubes, and a plurality of subpassages through which the refrigerant flows, wherein a number of refrigerant passages provided by the flat tubes, a number of levels of the flat tubes, a hydraulic diameter of the subpassages in the flat tubes, a number of subpassages in each of the flat tubes, a stack length of each of the flat tubes, and a number of columns of the flat tubes satisfy a relationship given by Expression (1):

$$2 \le D_n / N_p \le K \cdot \frac{D_e^5 \times (N_p \times n)^2}{L \times N_r} \quad (1)$$

where $D_n$ is the number of levels of the flat tubes, $N_p$ number of the refrigerant passages provided by the flat tubes, K is a constant determined by an upper limit pressure loss of the refrigerant in each of the refrigerant passages while the heat exchanger serves as an evaporator, $D_e$ is the hydraulic diameter of the subpassages in the flat tubes, n is the number of subpassages in each of the flat tubes, L is a stack length of each of the flat tubes, and $N_r$ is the number of columns of the flat tubes.

8. The heat exchanger of claim 7, wherein the fins are provided for each of the levels of the flat tubes, and wherein the flat tubes are bent at at least one position in the axial direction.

9. A refrigeration cycle apparatus comprising:

a refrigerant circuit through which refrigerant is circulated, the refrigerant circuit including a compressor, a condenser, an expansion device, and an evaporator connected sequentially by pipes, at least one of the condenser and the evaporator being the heat exchanger of claim 7.

10. A refrigeration cycle apparatus comprising:

a refrigerant circuit through which refrigerant is circulated, the refrigerant circuit including a compressor, a condenser, an expansion device, and an evaporator connected sequentially by pipes, at least one of the condenser and the evaporator being the heat exchanger of claim 7, the number of levels of the flat tubes for each of the refrigerant passages of the evaporator being set to a value that allows an evaporating temperature reduced by pressure loss of the refrigerant in the one of the refrigerant passages to exceed 0 degrees C. under a condition where a circulation amount of the refrigerant flowing into the evaporator is a maximum value and a temperature of the refrigerant flowing into the evaporator is a minimum value.

11. The heat exchanger of claim 7, wherein the flow direction of the gas is counter to flow of the refrigerant through the refrigerant passages in the column direction while the heat exchanger serves as a condenser.

12. The heat exchanger of claim 7, wherein the K being constant satisfies a relationship given by Expression (2):

$$K = \frac{P_{max} \times \pi^2 \rho_V}{8 G^2 x^2 \phi_V^2 f_r} \quad (2)$$

where $P_{max}$ is a difference between a pressure under conditions where a temperature of the refrigerant flowing into the heat exchanger is minimized and a saturated pressure, $\rho_V$ is saturated gas density at a minimized refrigerant evaporating temperature, G is a maximized circulation amount of the refrigerant flowing into the heat exchanger, x is a mean value of a quality of the refrigerant flowing into the evaporator and a quality of the refrigerant flowing out of the evaporator, $\phi_V$ is a friction loss increase coefficient in a two-phase flow which is determined on the basis of physical properties of the refrigerant, and f is a tube friction loss coefficient.

* * * * *